US006089049A

United States Patent [19]

Dawn

[11] Patent Number: 6,089,049

[45] Date of Patent: Jul. 18, 2000

[54] KNITTING MACHINE

[75] Inventor: Terry Dawn, Nottingham, United Kingdom

[73] Assignee: The RHD Company Limited, United Kingdom

[21] Appl. No.: 09/125,638

[22] PCT Filed: Feb. 24, 1997

[86] PCT No.: PCT/GB97/00502

§ 371 Date: Nov. 9, 1998

§ 102(e) Date: Nov. 9, 1998

[87] PCT Pub. No.: WO97/31143

PCT Pub. Date: Aug. 28, 1997

[30] Foreign Application Priority Data

Feb. 24, 1996 [GB] United Kingdom ..... 9603940

[51] Int. Cl.[7] ..... D04B 9/40

[52] U.S. Cl. ..... 66/148; 66/147

[58] Field of Search ..... 66/147, 148, 149 R, 66/150, 60 R, 64

[56] References Cited

FOREIGN PATENT DOCUMENTS

| | | |
|---|---|---|
| 0473317 | 8/1991 | European Pat. Off. . |
| 2005439 | 11/1970 | Germany . |
| 4332240 | 3/1995 | Germany . |

*Primary Examiner*—Danny Worrell
*Attorney, Agent, or Firm*—Cahill, Sutton & Thomas P.L.C.

[57] ABSTRACT

A knitting machine including a first knitting station (51) for knitting a welt, a second knitting station (52) comprising a fully fashioned knitting head (54), and a transfer system including a welt transfer bar (60) and a transfer bar transport system (72, 73), the transfer bar being movable by the transport system from a loading station, whereat a welt knitted at the first knitting station (51) can be loaded onto the transfer bar (60), to an unloading station whereat the knitted welt loaded on the transfer bar can be transferred to the knitting head at the second knitting station (52).

26 Claims, 10 Drawing Sheets

KNITTING MACHINE

CROSS REFERENCE TO RELATED APPLICATION

The present application is an application filed under the National Phase of and claims priority to PCT application entitled "Knitting Machine" assigned Serial No. GB97/00502 and filed Feb. 24, 1997, which PCT application claims priority to a patent application filed in Great Britain entitled "Knitting Machine", assigned Serial No. 96-03940.9 and filed Feb. 24, 1996, each of which describe inventions made by the present inventor and assigned to the present assignee.

BACKGROUND OF THE INVENTION

1. Field of the Invention

The present invention relates to a knitting machine for producing fully fashioned garments, in particular but not exclusively, fully fashioned garments including knitted rib welts.

2. Description of Related Art

A conventional fully fashioned knitting machine, for example the Cotton Patented knitting machine, usually includes a pair of narrowing combs associated with each knitting head to enable widening/narrowing operations to be performed during knitting.

Conventionally the narrowing combs of each pair are fixedly mounted on an associated carried bar which is longitudinally displaced in a controlled manner to accurately position each comb for the widening/narrowing operation. Conventionally the drive force for moving each carrier bar longitudinally is achieved by mechanical means such as cams and levers.

Such mechanical means are relatively slow in operation, require constant maintenance and are noisy in operation.

One aim of the present invention is to overcome or substantially reduce the disadvantages associated with mechanical drive means for the narrowing combs.

In the production of fully fashioned garments, it is common practice to knit rib welts on a rib knitting machine, such as a V-bed knitting machine and then to transfer the knitted welt to a fully fashioned knitting machine for knitting of the remainder of the garment. Transfer of the knitted welt is achieved by transferring the knitted rib on to a transfer bar which comprises a rigid elongate body having a comb of transfer needles or points spaced along its length. The loaded transfer bar is then transferred to a fully fashioned knitting machine whereat the knitted rib welt is transferred onto the knitting needles of the fully fashioned knitting machine. The rib knitting machine can produce finished knitted rib welts at a faster rate than the fully fashioned knitting machine requires and so it is common practice to locate the rib knitting machines and fully fashioned knitting machines at different sites and store the knitted rib welts on the transfer bars in readiness for loading onto the fully fashioned knitting machine.

It is a general aim of the present invention to provide a knitting machine which renders more efficient the production of fully fashioned garments comprising knitted rib welts and knitted body fabric which are knitted on different machines.

SUMMARY OF THE INVENTION

According to one aspect of the present invention there is provided a knitting machine including a first knitting station for knitting a welt, a second knitting station comprising a fully fashioned knitting head, and a transfer system including a welt transfer bar and a transfer bar transport system, the transfer bar being movable by the transport system from a loading station, whereat a welt knitted at the first knitting station can be loaded onto the transfer bar, to an unloading station whereat the knitted welt loaded on the transfer bar can be transferred to the knitting head at the second knitting station.

Preferably the transport system includes a carrier for the transfer bar. The carrier may driven between the first and second knitting stations by a linear motor which may either be a stepper linear motor or a continuously operable motor controlled by an encoder.

According to another aspect of the present invention there is provided a fully fashioned knitting machine having at least one knitting head and at least one pair of narrowing combs associated with said one knitting head, each comb of said pair being associated with a respective linear motor arranged to move the associated comb across said knitting head, and electronic control means for positioning each linear motor at a desired position relative to said knitting head.

Preferably both linear motors associated with said pair of narrowing combs are mounted on a common carrier bar which is fixedly mounted to prevent its longitudinal movement.

The linear motors may be stepper motors or may be continuously operable motors controlled by encoders which sense the displacement of the motor along the carrier bar.

Preferably the second knitting station comprises a fully fashioned knitting machine as defined above. Preferably said fully fashioned knitting machine includes two pairs of narrowing combs associated with the knitting head.

According to another aspect of the present invention there is provided a method of transferring a knitted loop held on a knitting needle to a transfer point, the knitting needle having a hook and being reciprocated in advance and retract directions to form knitted loops, the method including the stages of:

i. moving the transfer point longitudinally along a path of travel from a loaded piston to a transfer position, the transfer point during movement along said path to the transfer position being guided to penetrate the held loop at a location behind the hook of the needle, ii. moving the needle in its advance direction to a knock-over position whereat the held loop clears the hook, iii. moving the held loop in the advance direction of the needle to transfer the held loop from the needle to the transfer point and subsequently moving the transfer point to its loaded position.

BRIEF DESCRIPTION OF THE DRAWINGS

Various aspects of the present invention are hereinafter described with reference to the accompanying drawings, in which.

DETAILED DESCRIPTION OF THE INVENTION

Figure 1:
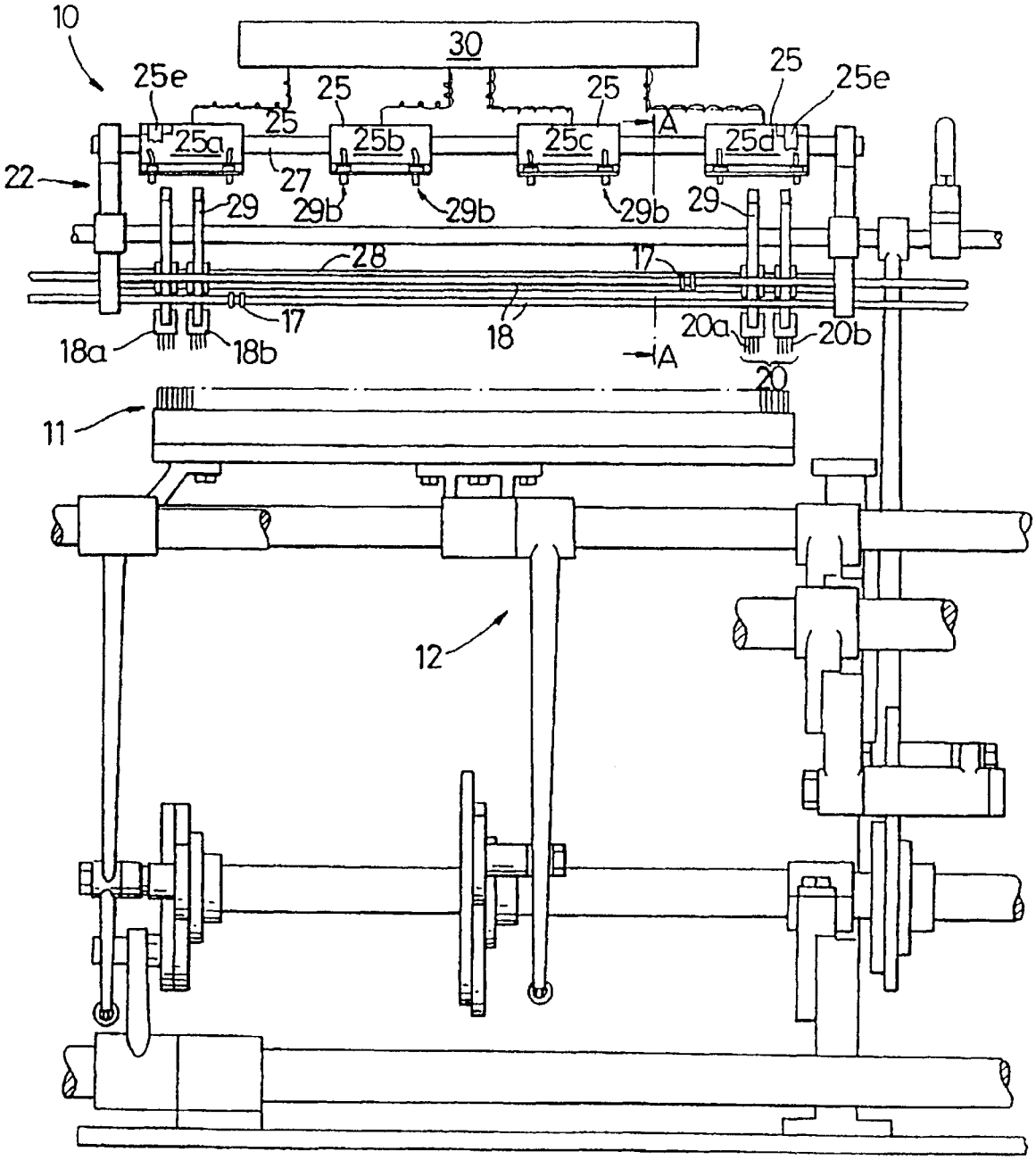
FIG. 1 is a simplified front view of a fully fashioned knitting machine according to one embodiment of the present invention.
Figure 1A:
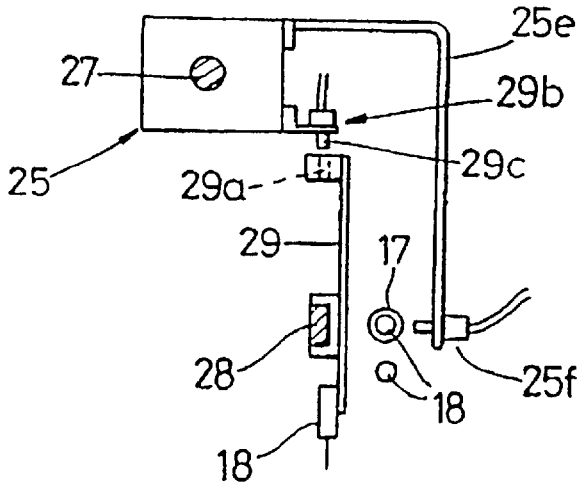
FIG. 1*a* is a part section taken along line A—A in FIG. 1.

In FIG. 1 there is shown part of a fully fashioned straight bar knitting machine 10. The machine 10 includes a needle bar 11 which is mounted and arranged to be driven in a conventional manner by a mechanism 12.

The machine 10 includes two pairs of narrowing combs 18, 20 respectively. Both pair of combs 18, 20 are mounted upon a drive frame 22 which is arranged to move the pairs of narrowing combs 18, 20 in a conventional manner toward and away from the needle bar 11 during the narrowing/widening operation.

In accordance with the present invention the pairs of narrowing combs 18, 20 are moved across the needle bar 11 during the narrowing/widening operation by stepper linear motors 25.

Four linear motors 25*a* to 25*d* are provided, each of which is movably mounted on a common rail 27 which is mounted on the drive frame 22.

The combs 18*a*, 18*b* and 20*a*, 20*b* are each mounted on the lower end of a respective support arm 29, each arm 29 being slidably mounted on a common rail 28, preferably by means of a linear bearing, e.g. a roller bearing assembly.

Each arm 29 at its upper end is provided with a drive connection formation, preferably in the form of an aperture 29*a*, for driving connection with a selectable co-operating drive connection formation 29*b* mounted on each linear motor 25. The formation 29*b* is preferably in the form of a retractable piston 29*c* which is fluid or electrically operated. When extended the piston 29*c* enters a respective aperture 29*a* to drivingly connect a linear motor 25 to the associated comb.

Preferably each linear motor 25 is provided with two drive connection formations 29*b* each of which is closely located to opposite ends of the motor. By selecting which of the formations 29*b* is used on any one motor 25, a wide range of operating distances between the combs can be accommodated.

Preferably, for lace knitting in a conventional manner, rails 18 are provided on which lace stops 17 are slidably mounted. The outmost linear motors 25*a*, 25*d* are provided with additional brackets 25*e* which carry selectable drive engagement means 25*f* similar to formation 29*b*.

An electronic controller 30 is wired to each linear motor 25 and is operable to send control pulses to the motors for controlling positional movement of the respective motors 25 along the bar 27. Suitable stepper linear motors are the 'L series' linear stepper motors supplied by Parker.

As an alternative to the use of stepper linear motors, it is envisaged that the linear motors may be continuously movable and that encoders be provided to sense the displacement of the motors along bar 27. The controller 30 would then be responsive to the signals produced by the encoders for controlling the position of the motors along bar 27.

Figure 2A:
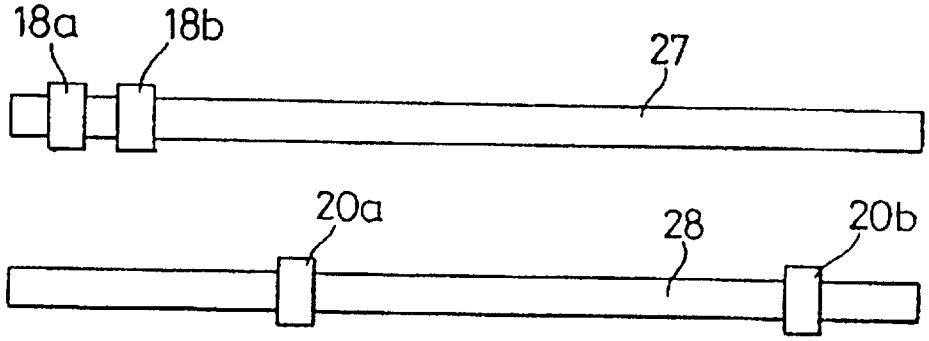
FIGS. 2*a*, 2*b* are diagrammatic representations showing relative positions of two pairs of narrowing combs for knitting single for two garment panels on the knitting head of FIG. 1.
Figure 2B:
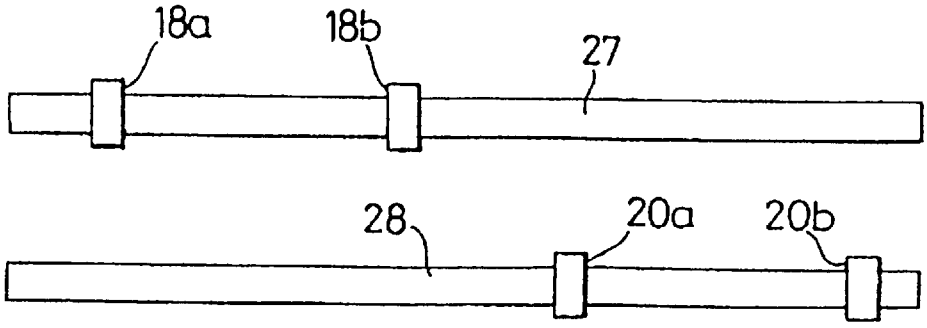

As indicated in FIGS. 2*a*, 2*b* the motors 25 may be controlled to enable a single garment panel to be produced (FIG. 2*a*) or two garment panels to be simultaneously produced (FIG. 2*b*).

In FIG. 2*a*, the pair of combs 18 are moved to the extreme left to a parked position and the pair of combs 20 are positioned so as to produce a single knitted garment panel.

When it is desired to knit two garment panels simultaneously, both pairs 18, 20 of combs are arranged to co-operate with the needle bar 11 as indicated in FIG. 2*b*.

Conventional yarn guides are provided (not shown) for feeding yarn to the needle bar 11. If for example 6 yarn guides are provided, then 3 yarn guides would be used in co-operation with the comb pair 18 and the other 3 yarn guides would be urged in co-operation with comb pair 20. Thus during knitting using the arrangement shown in FIG. 2*a*, only 3 yarn guides would be used whereas using the arrangement shown in FIG. 2*b*, all 6 yarn guides would be used.

The yarn guides may be driven by conventional means, viz a cam box driven by cams and levers.

Figure 5A:
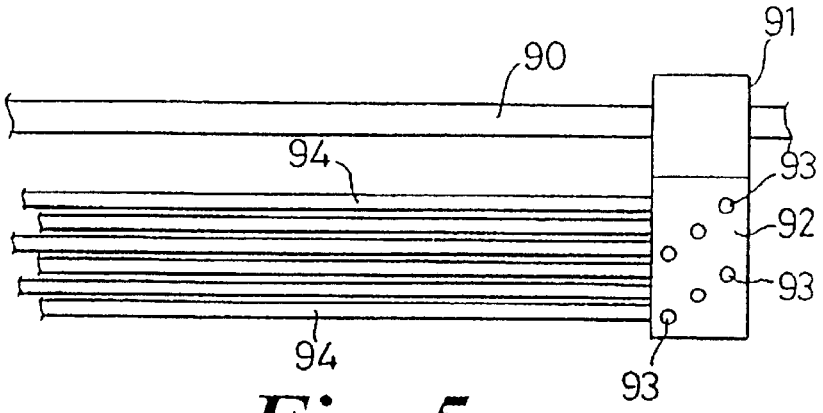
FIGS. 5*a* and 5*b* are a schematic plan view and side view of a drive cam box and associated yarn feeder carriers.
Figure 5B:
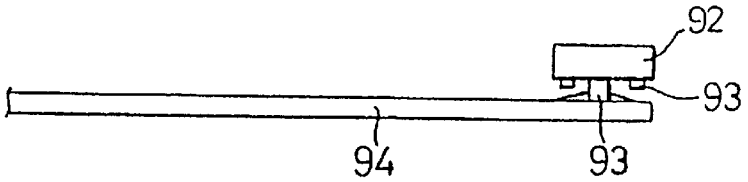

However, as an alternative, it is preferred to replace the cams and levers by a linear motor for driving the cam box. This is schematically shown in FIGS. 5*a*, 5*b* wherein a rail 90 is provided extending on which a linear motor 91 is mounted. A cam box 92 is mounted on the linear motor 91 and is provided with a series of pneumatically operated plungers 93 which co-operate with respective individual yarn feeder bars 94. Yarn feeder bars 94 are mounted in the frame of the machine and carry individual yarn feeders in a conventional manner.

Selection of individual yarn feeders is achieved by activating the relevant plunger 93 to engage its associated bar 94 and then activating the linear motor 91 to traverse along rail 90.

The needle bar 11 is preferably longer than usual, for example preferably about 44 inches long and is preferably provided with sinker drive means 110 (FIG. 6) for driving the sinkers. It will be appreciated however, that if desired, conventional drive means may be provided for driving the sinkers B although these would be slower, noisier and require more maintenance.

Figure 6:
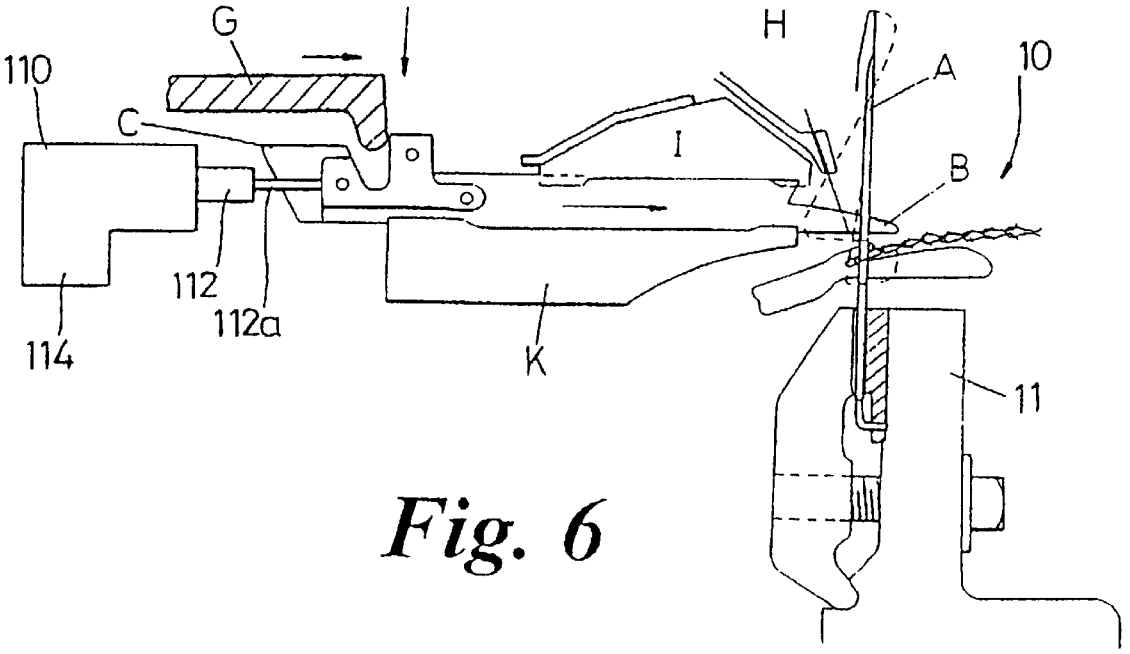
FIG. 6 is a side view of the knitting head shown in FIG. 1.

As shown in FIG. 6, the knitting machine 10 includes knitting needles A held in a needle bar 11. Sinkers B (typically one between every two needles) are slidingly received in a sinker bar K which extends along the length of the knitting head. Dividers C are usually located inbetween each pair of neighbouring sinkers.

A catch bar G extending along the length of the knitting head is provided for advancement of the dividers and the simultaneous retraction of the sinkers and dividers.

A sinker drive mechanism 110 is provided for advancing the sinkers B. The drive mechanism 110 basically comprises a series of independently movable striking pistons 112 housed in a support body 114 which extends along the length of the knitting head, there being one striking piston 112 for striking sinker B. The body 114 is conveniently mounted upon the machine bed which normally supports the conventional slur cock rail.

The pistons 112 are operated in sequence along the length of the support body 114 so as to operate the sinkers B sequentially along the knitting head; retraction of the pistons 112 being achieved by the conventional motion of the catch bar G when retracting the sinkers B and dividers C.

Figure 8:
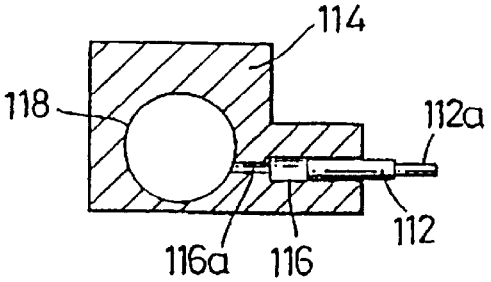
FIG. 8 is a cross-sectional view taken along line V—V in FIG. 7.

As shown in FIGS. 6 and 8, the pistons 112 are preferably each in the form of a rod having a close tolerance fit within a cylinder bore 116. Seals between the piston 112 and associated cylinder bore 116 are preferably not provided in order to avoid lubrication, overheating and seizure problems. Instead, the cylinder bore 116 and/or the pistons 112 are coated with a hard wearing low friction material such as polytetrafluoroethylene. A conventional coating process known as the 'Nyflor' process is used in order to attain a coating having a hardness in the range of 800–1000 Vickers. The tolerance between the piston 112 and associated cylinder bore 116 is chosen to give the desired pressure sealing characteristics for advancing the pistons 112 when exposed to pressurised fluid. The tolerance is preferably 0 to 1 thousandth of an inch for a piston 112 of 3/16 inch diameter.

Preferably as shown in FIGS. 6 and 8, the pistons 112 include a head 112*a* of reduced diameter to enable the piston to extend inbetween adjacent dividers C for operating the sinker B located therebetween.

Figure 9:
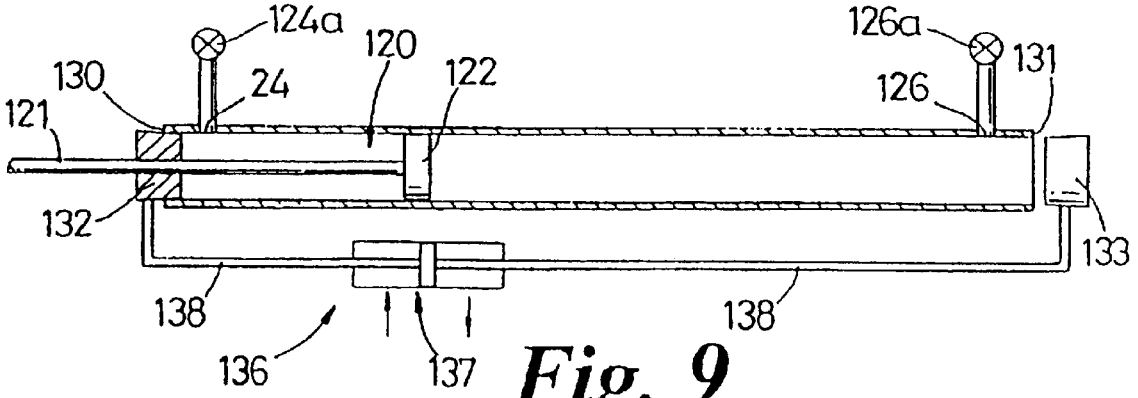
FIG. 9 is a diagrammatic axial sectional view of the drive mechanism shown in FIG. 7.

Sequential advancement of the pistons 112 is preferably achieved as indicated in FIG. 9.

Preferably the support body 114 includes an elongate cylinder bore 118 in which a piston 120 is housed. The piston 120 includes a piston stem 121 having a piston head 122. Preferably, the piston head 122 carries one or more piston rings (not shown) made for example from cast iron for providing a seal between the piston head 22 and bore 18.

Preferably the piston 120 is rotatable about its longitudinal axis and indexing means (not shown) are preferably provided for indexing the piston 120 through a small arc prior to each stroke of the piston. In this way wear on the piston rings caused by the mouths of bores 116 is evenly distributed about the circumference of the piston rings.

Located at one end of the cylinder bore 118 is a port 124 having a valve 124*a* and located at the opposite end of the cylinder bore 118 is a port 126 having a valve 126*a*. All the cylinder bores 116 communicate with the cylinder bore 118 via conduits 116*a*.

During one knitting cycle, the piston head 122 is driven from one end to the other end of the bore 118. At commencement of the stroke of the head 122, all pistons 112 reside at their retracted positions due to the return motion of the catch bar G during the previous knitting cycle.

Immediately prior to the advancement of piston head 122, the port 124, 126 located at the advancement side of piston head 122 is closed and the port 124, 126 located on the downstream side of the piston head 122 is connected to a source of pressurised fluid, typically compressed air. Typically the source of pressurised air is at a pressure of 150 psi; the pressure for advancing each piston being typically 2 psi.

Accordingly, as the piston head 122 advances, it sequentially opens communication between successive cylinder bores 116 and the pressurised fluid on the downstream side of the piston head 122 and so sequentially advances neighbouring pistons 112 as it proceeds toward the upstream end of the cylinder bore 118.

Preferably the size of the conduits 116*a* is chosen such that the conduit opening neighbouring of neighbouring conduits 116*a* are sufficiently spaced from one another in the axial direction of bore 118 such that each piston 112 is fully advanced before the next succeeding piston 112.

Accordingly, the piston 120 effectively acts as a linear valve for sequentially supplying pressurised fluid to successive cylinder bores 116.

After all the pistons 112 have been advanced, cylinder bore 118 is vented to enable the catch bar G to subsequently retract all the pistons 112 during the later stages of the knitting cycle.

Figure 7:
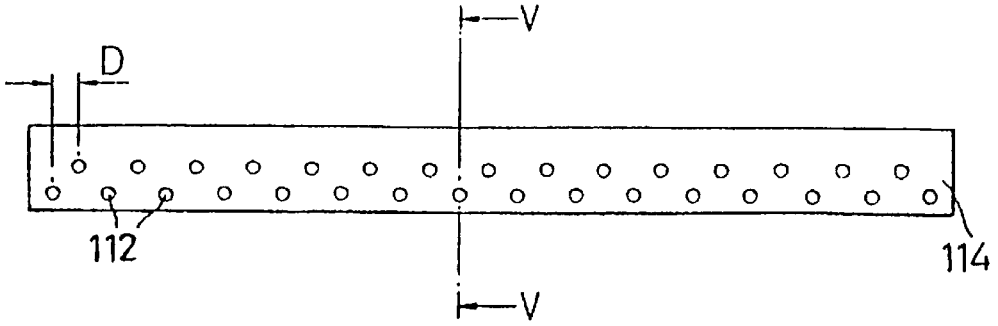
FIG. 7 is a front view of the drive mechanism shown in FIG. 6.

Preferably as shown in FIG. 7, the pistons 112 are arranged in laterally spaced rows extending along the length of the body 114, the pistons 112 in each row being staggered to thereby enable a minimum pitch distance D to be achieved. The pitch between the pistons 112 corresponds to the distance between adjacent sinkers B so that there is one piston 112 per sinker.

In the event that the knitting machine has sinkers only (ie. the dividers are replaced by sinkers and associated striking jacks) then additional pistons 12 would be provided.

Typically for machines of 21 to 30 gauge, the diameter of the pistons 112 would be about 3/16 inch.

An alternative arrangement is illustrated in FIG. 6 for controlling pressurised fluid to the cylinder bore 16 and for venting one end. During advancement of the piston head 122 it is necessary to vent the bore 118 (on the advancement side of the piston) in order to avoid pressurisation of the bore 118 and premature advancement of the pistons 112.

As shown in FIG. 9 the cylinder bore 118 is open ended at both ends to define large venting ports 130, 131 respectively.

A pair of valve elements 132, 133 are provided for sealingly closing respective ports 130, 132. Preferably as shown, valve elements 132, 133 are connected to a common drive mechanism 136 simultaneously closing and opening of the ports 130, 132. In FIG. 9, the drive mechanism 136 includes a piston and cylinder assembly 137 which through connecting rods 138 move the valve elements 132, 133.

Figure 10:
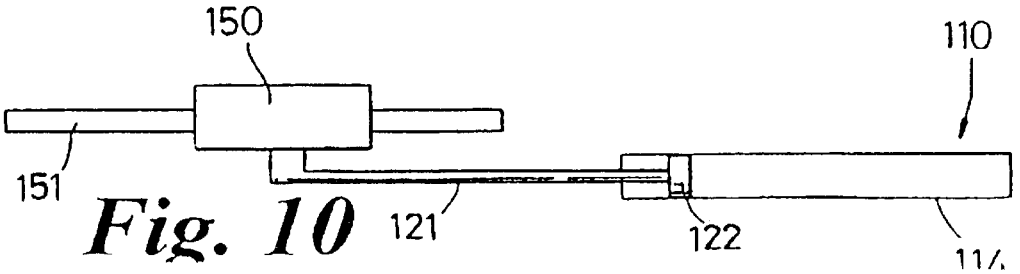
FIG. 10 is a schematic diagram illustrating driving means for the drive mechanism of FIG. 7.

In FIG. 10, a drive means for piston 120 is illustrated which is particularly suitable for a knitting machine having a single knitting section. In FIG. 10, the piston rod 121 is connected to a linear motor 150 which is arranged to reciprocate along a rail 151. A suitable linear motor is a microstepping motor, as for example a 'L-series stepping linear motor' as produced by Parker. A stepping linear motor is preferred as it can be controlled to accelerate/decelerate in a desired manner during its reciprocal driving stroke of the piston 120.

As an alternative, it is envisaged that the linear motor may be a continuously operable linear motor controlled by an encoder which responds to displacement of the motor.

Figure 3:
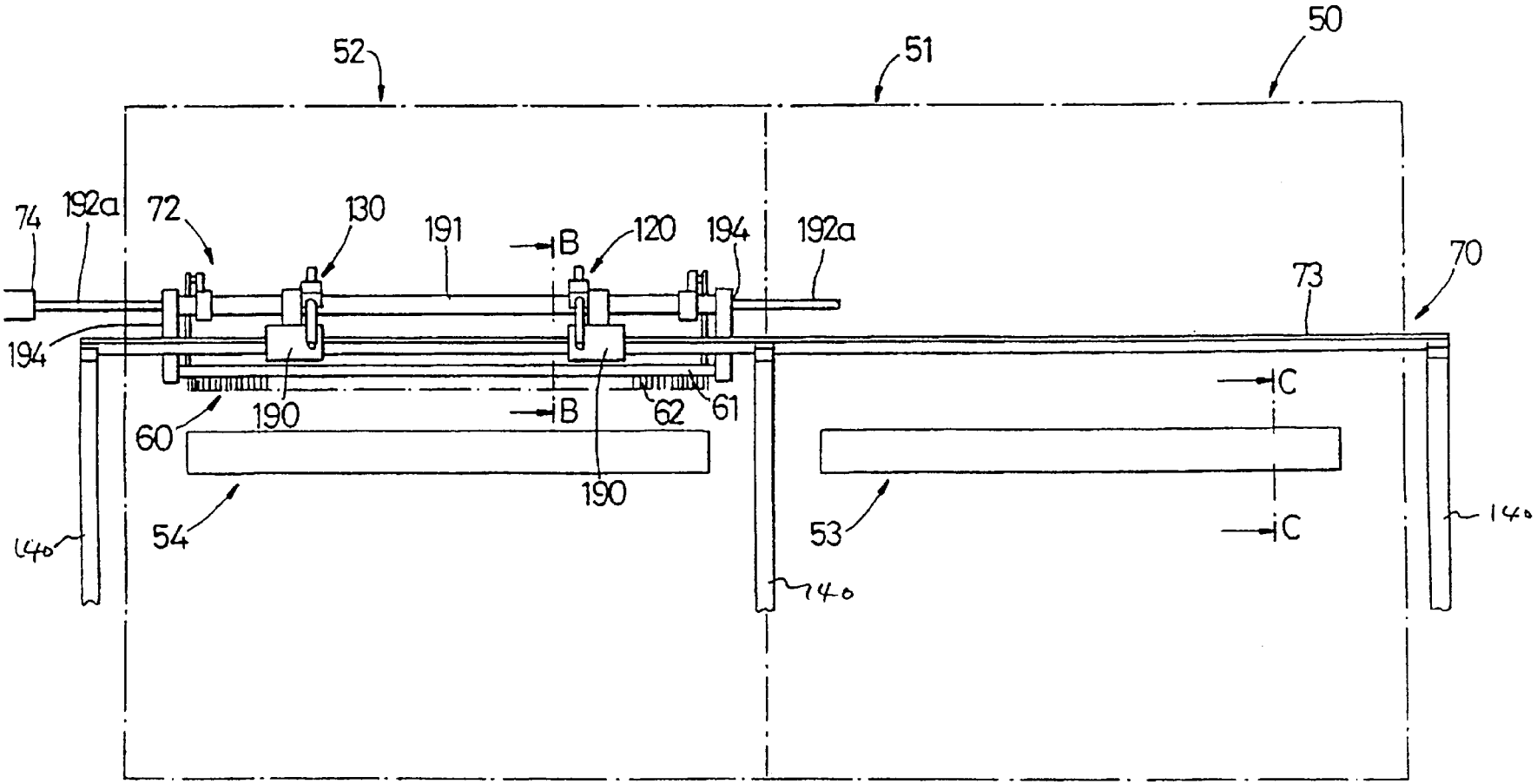
FIG. 3 is a schematic diagram of a knitting machine according to the present invention for knitting rib welts and garment panels.

In FIG. 3 there is schematically shown a knitting machine 50 according to the invention which is suitable for producing garments having separately knitted welts and body fabric.

The knitting machine 50 includes two separate knitting stations 51, 52 respectively; knitting station 51 including a conventional knitting head 53 capable of producing knitted welts and knitting station 52 including a fully fashioned knitting head 54 capable of producing fully fashioned garment panels. Preferably, the knitting station 51 is a V-bed knitting machine. The knitting station 52 in the present example is the single knitting head fully fashioned machine 10 described above.

A knitted welt transfer bar 60 and a transfer bar transport system 70 are provided for transferring welts knitted at station 51 to the knitting head at station 52. The transfer bar 60 is of conventional construction, viz it has a rigid elongate body 61 from which a comb of transfer needles i.e. points 62 project.

Figure 13A:
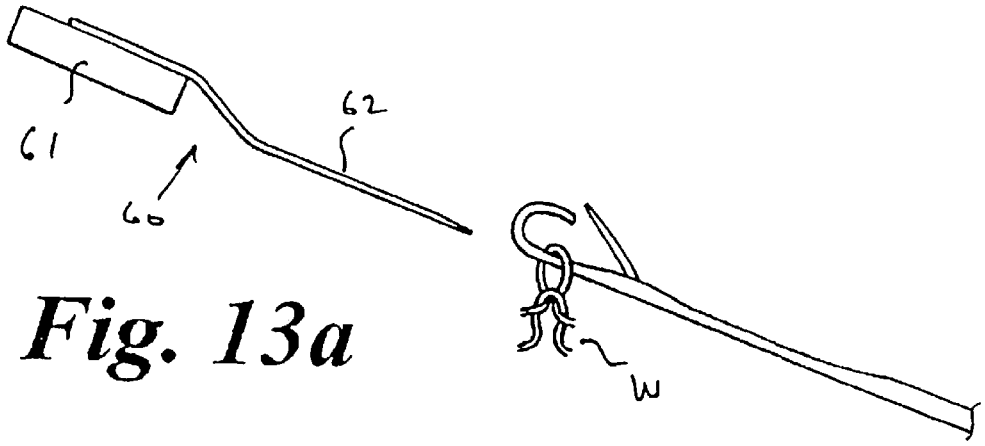
FIGS. 13*a* to 13*d* are respective diagrammatic views showing a welt transfer sequence according to the present invention.
Figure 13B:
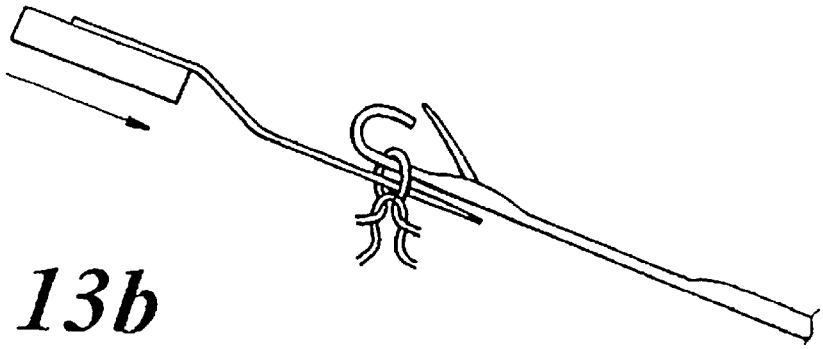
Figure 13C:
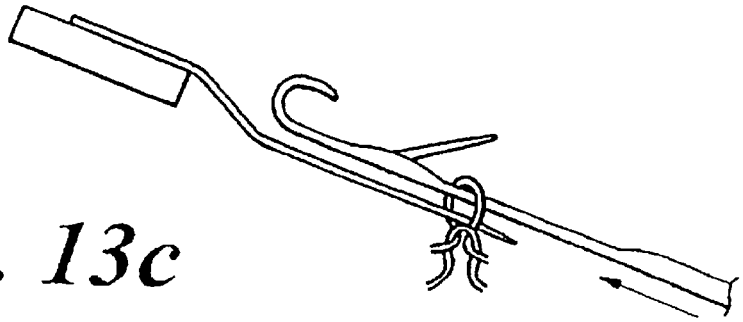
Figure 13D:
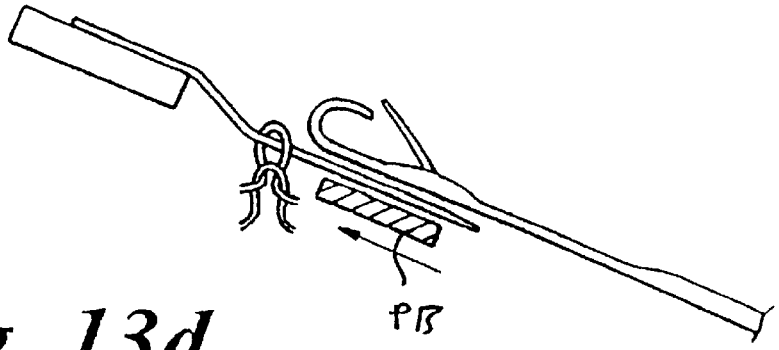

The sequence of effecting transfer of a knitted welt from the knitting head 52 and onto the transfer bar 60 is schematically illustrated in FIGS. 13*a* and 13*d*.

In FIG. 13*a,* the knitted welt W has been completed and all loops held on the front needle bed FB have been transferred on the needles NR of the near rear needle bed RB in a conventional manner.

The transfer bar is advanced so that the points 62 extend longitudinally to penetrate the held loops at a position behind the needle hook NH. This is illustrated in FIG. 13*b* and is shown in broken lines in FIG. 11.

The needles NR are now advanced in their extend direction to a knock-over position (FIGS. 13*c* and 11) so that the held loop clears the latch NL.

In FIG. 13*d* a push bar PB located beneath the rear bed RB is now advanced to push the welt W toward the transfer bar 60. Such movement causes the knitted loops to clear the needles NR and move further down the shank of the transfer points 62.

The transfer bar 60 is now retracted to remove the transferred welt W from the knitting head 53.

The transport system 70 includes a transfer bar carrier 72 on which the transfer bar 60 is movably mounted for effecting transfer of a knitted welt from the knitting head 52 and effecting transfer of a knitted welt to the knitting head 51.

The carrier 72 is movably mounted on a carrier rail 73 and is driven therealong between a transfer bar loading position (LP) and a transfer bar unloading position (UP). The carrier 72 may be driven along rail 73 by a linear motor or other suitable means such as a hydraulic piston 74.

The carrier 72 includes a pair of support blocks 190 which are each slidingly received upon rail 73. Each support block 190 includes a bush (not shown) which rotatably receives a support sleeve 191. The sleeve 191 is also received in support blocks 190 so as not to be movable axially relative thereto. A drive shaft 192 is rotatably received within the sleeve 191 and has end portions 192*a* which project outwardly from the sleeve 191 at both ends. A pair of support arms 194 are provided for retaining and guiding movement of the transfer bar 60. Each of the support arms 194 being fixedly secured to a respective end portion 192*a*.

Figure 4A:
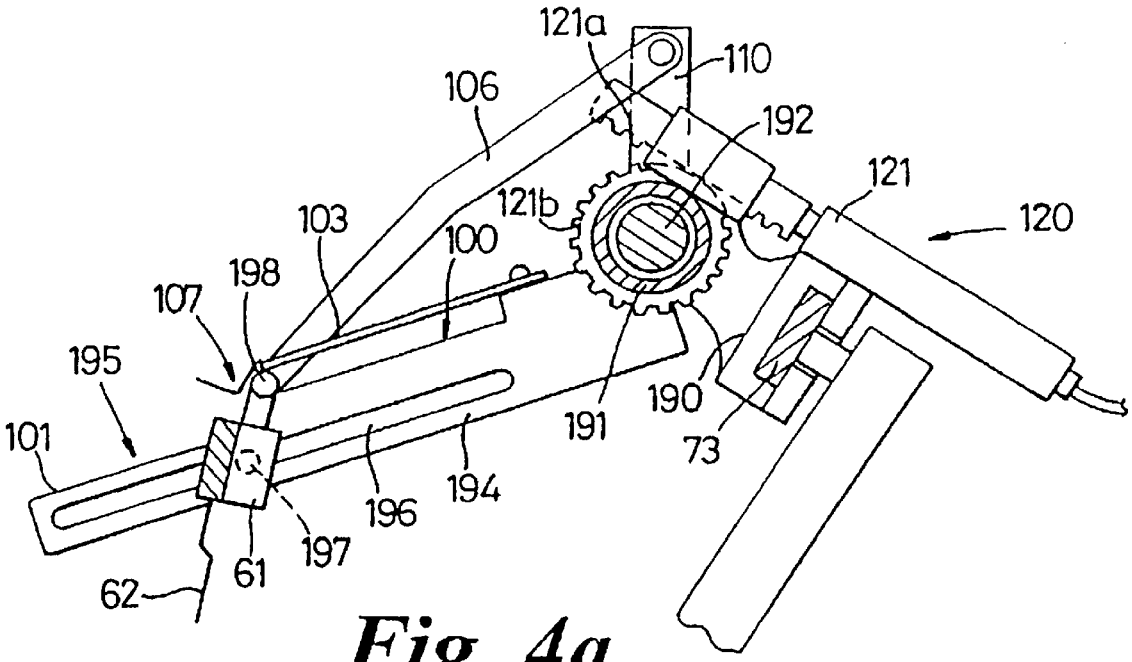
FIGS. 4*a*, 4*b* and 4*c* are part sectional views taken along line B—B in FIG. 3 shown in different operating modes.
Figure 4B:
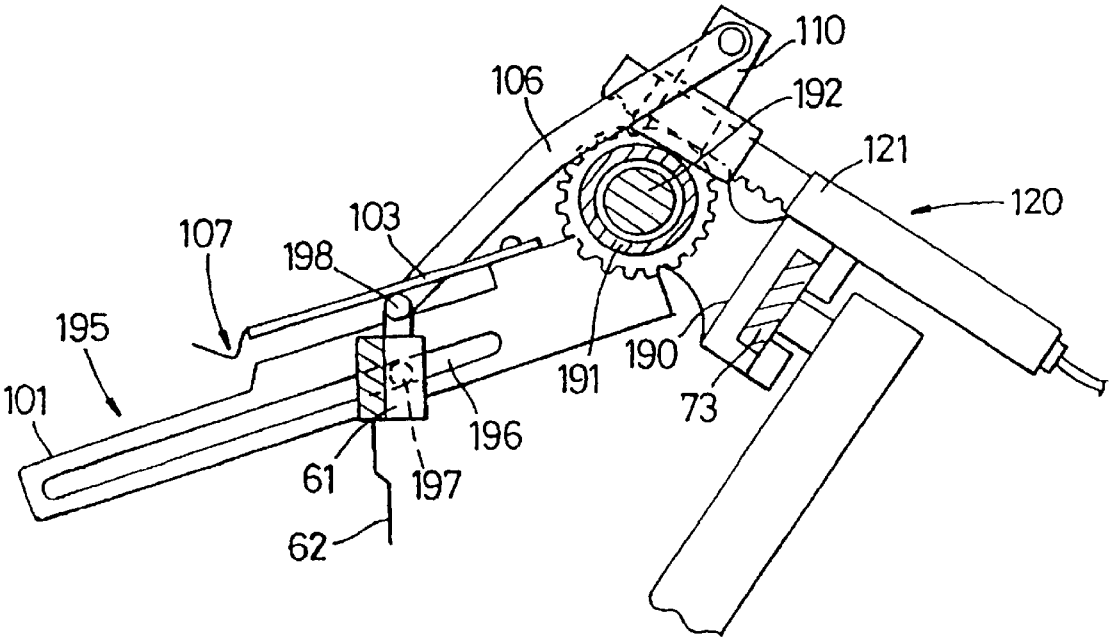
Figure 4C:
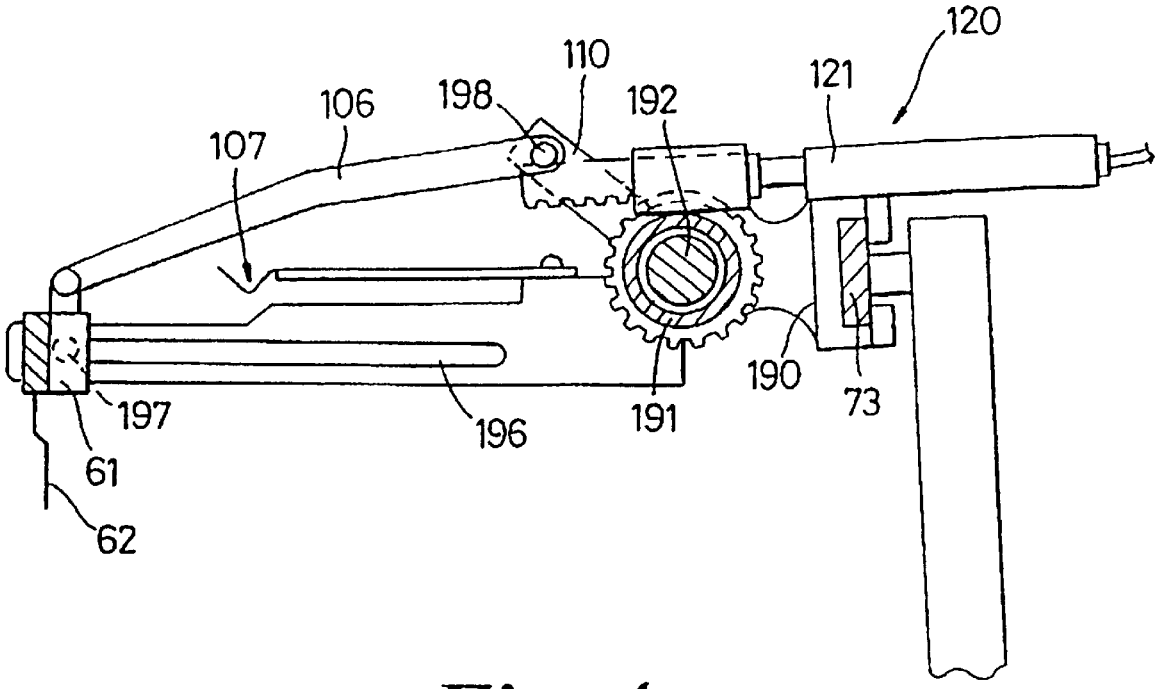

As shown more clearly in FIGS. 4*a* to 4*c* each support arm 194 includes a stepped upper surface 195 and a guide groove 196.

Each end of the transfer bar 60 is provided with two guide pins 197 and 198. Guide pin 197 is located within groove 196 and guide pin 198 rides upon the upper surface 195.

The upper surface 195 includes a raised stepped portion 100 and a lower stepped portion 101. A resilient tongue 103 is mounted upon the arm 194 above surface portion 100 and is located above pin 198 to resiliently urge the pin 198 into contact with surface 100.

A drive arm 110 is fixedly mounted on the support sleeve 191 and is connected to the pin 198 via a link arm 106.

A motive drive means 120, preferably in the form of a fluid actuated piston 121, is mounted on one of the support blocks 190. The piston drives a rack 121*a* which meshes with a pinion 121*b* mounted on the sleeve 191 and acts to rotate the sleeve 191 and thereby cause arms 110 to be angularly displaced about the axis of drive shaft 192. Arms 110 are displaceable between a first extreme limit position as shown in FIG. 4*b* and a second extreme limit position as shown in FIG. 4*c*.

In the position shown in FIG. 4*b,* the transfer bar 60 is positioned at an innermost position (relative to the carrier 72) and is at a position suitable for the carrier to move between its loading and unloading positions along rail 73. In the position shown in FIG. 4*a*, the carrier 72 is located at its loading position in order to load a knitted welt from the knitting head 52.

In this position, the drive means 120 has been operated to advance the transfer bar 60 to an intermediate position between the first and second extreme limit positions. At the intermediate position the pin 198 abuts and stop formation 107 on tongue 103 and so is resiliently held in this position whilst the loop transfer sequence as described in connection with FIGS. 13*a* to 13*d* is performed.

One of the support blocks 190 carries drive means 130 similar to drive means 120. Drive means 130 is arranged to rotate drive shaft 192 and so enable the support arms 194 to be angularly moved relative to the axis of the drive shaft 192.

Accordingly by appropriate operation of the drive means 120, 130 it is possible for the points 62 on the transfer bar to undergo accurate displacement to insert the points into the loops held on the head 53 for effecting loading of the welt bar 60.

The transfer bar 60 is now in a position corresponding to that shown in FIG. 13*b*.

In order to transfer the welt onto the transfer bar 60 (as per FIG. 13*d*), the rear needle bed is provided with a plurality of slides 200 which are slidably mounted in grooves 201 formed in the underside of the needle bed RB. The upper end of each slide is secured to a welt push bar PB which extends along the length of the rear bed. Each slide 200 at its lower end is provided with a drive pin 205 which is received in an inclined groove 207 formed in a drive bar 214. The drive bar 214 is displaceable longitudinally by drive means 220, for example a fluid actuated piston and cylinder. Advancement of the bar 214 causes all slides 200 to simultaneously advance the push bar PB to push the welt W off the needles NR.

Figure 11:
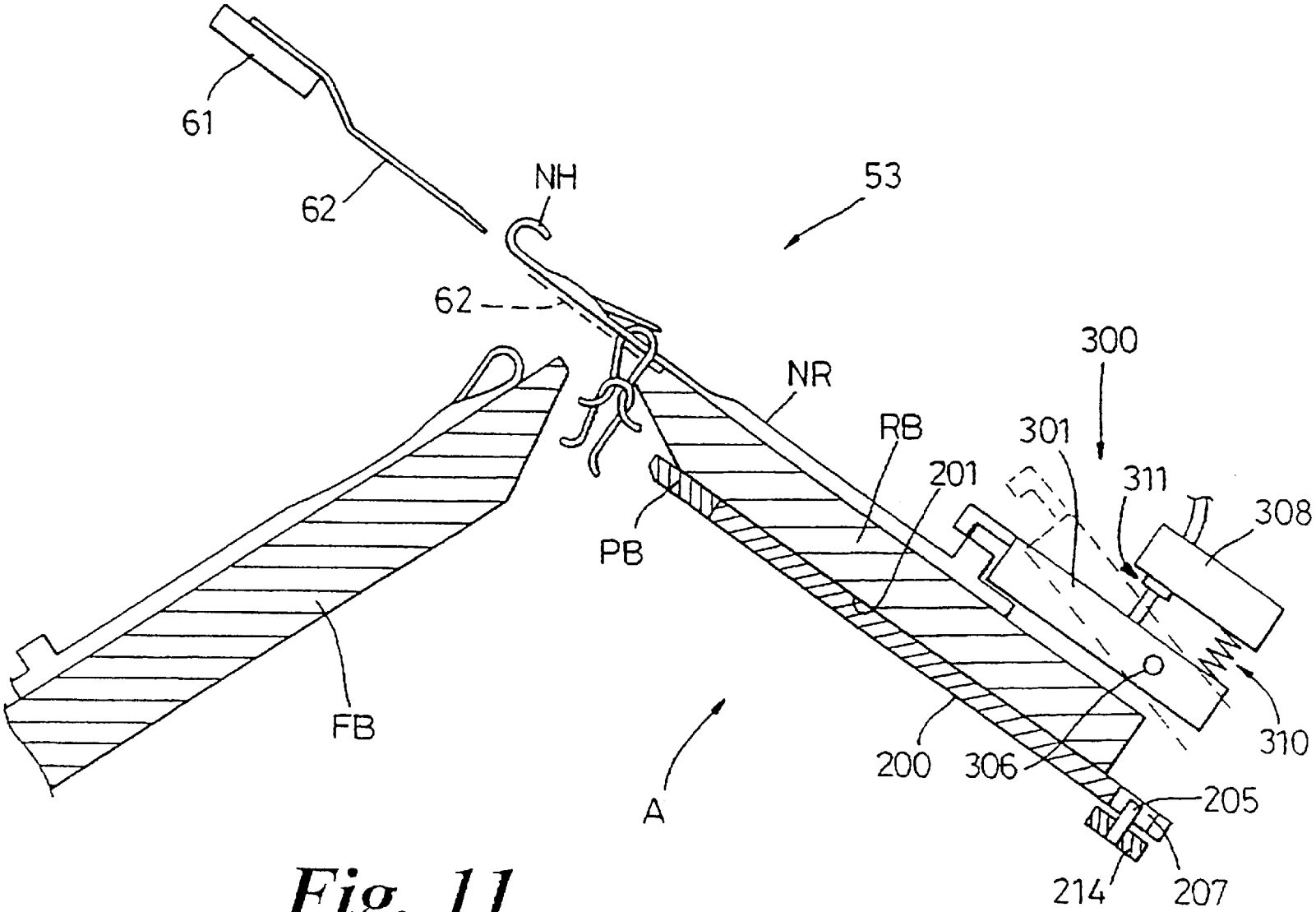
FIG. 11 is a part section along line C—C in FIG. 3.
Figure 12:
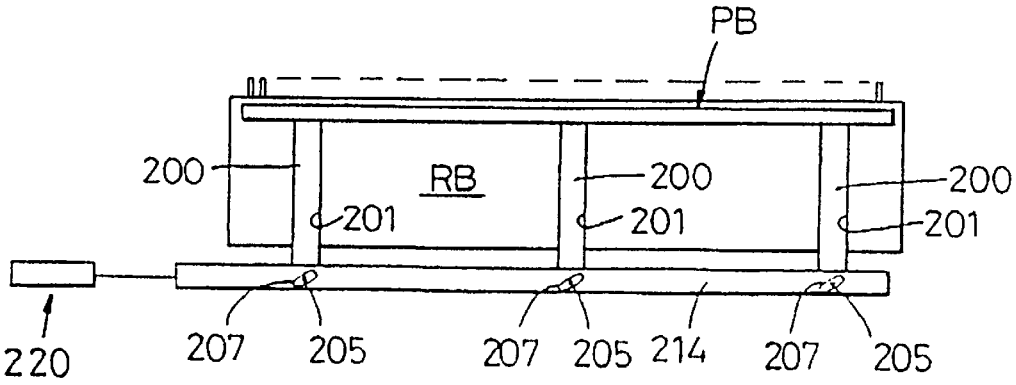
FIG. 12 is a schematic view taken in direction of arrow A in FIG. 11.

Retraction of the bar 214 causes all slides 200 to simultaneously retract the push bar PB to the position illustrated in FIG. 11 whereat it resides in readiness for the next welt transfer sequence.

After loading of the transfer bar, arms 194 are raised by rotation of drive shaft 192 and the transfer bar 60 is retracted to its innermost position as seen in FIG. 4*a*.

The carrier 72 is now displaced along rail 73 to its unload position.

At the unload position, arms 110 are displaced toward their second extreme position by rotation of sleeve 191. This causes the transfer bar 60 to be displaced to an outermost position, with pin 197 abutting the terminal end of the groove 196. The outermost position of the transfer bar 60 is reached before the arms 110 reach their second extreme limit position. Accordingly further displacement of the arms 110 to their second extreme limit position, causes the transfer bar 60 to pivot about pins 197 to reach the position shown in FIG. 4*c*.

The rail 73 is mounted on arms 140 which are pivotedly attached to the main frame of the machine. The arms 140 are movable about their pivotal connection by suitable drive means (not shown) such as a fluid operated piston and cylinder. As seen in FIG. 4*c*, rail 73 has been move inwardly toward the knitting head 54 by pivotal movement of the arms 140. This ensures that the transfer bar 60 is oriented substantially vertically in order to correctly position the transfer bar 60 for unloading the welt onto the needles of knitting head 54.

Once the transfer bar 60 has been unloaded it is returned the piston shown in FIG. 4*b* and 72 is then returned along rail 73 to its loading position (LP). During transfer of a loaded welt to the knitting station 52, knitting of a new welt at station 51 can be commenced.

Typically the knitting of a welt at station 51 is faster than the knitting of a garment panel at station 52 so that station 51 is capable of supplying welts to the station 52 in order to maintain station 52 in continuous operation only using a single transfer bar.

Figure 14:
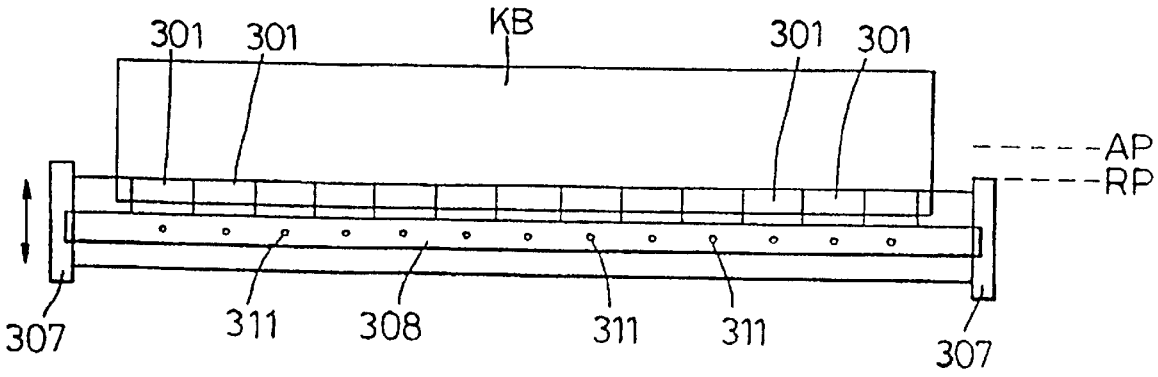
FIG. 14 is a schematic plan view of the rear needle bed shown in FIG. 11.

As seen in FIGS. 11 and 14, the V-bed knitting head is preferably provided with a needle selection means 300 which operates on the front and rear bed (only shown in FIG. 11 on the rear bed). The needle selection means 300 for each bed includes a series of independently pivotally mounted plates 301 which are mounted side by side along the needle bed. Each plate 301 is pivotally mounted on a shaft 306 which is secured at opposite ends on slide blocks 307 which are slidably mounted on the frame of the machine.

A mounting bar 308 is secured at opposite ends to the sliding blocks 307 and is spaced above the plates 301 as seen more clearly in FIG. 11.

Individual biasing means 310 and selectable drive means 311 are mounted on the bar 308 for co-operation with each plate 301. The biasing means 310, such as a spring, is located on one side of the shaft 306 so as to be biased in upward direction to reside at the in-operative positive as shown by the broken lines in FIG. 11.

Drive means 311, such as a fluid actuated piston, are located on the opposite side of the shaft 306 and when activated serve to deflect the associated plate 301 downwardly to the operative position as shown in solid lines in FIG. 11.

The plates 301 are arranged to overlie the lower portion of the associated needle bed and are adapted for engagement with the butts 330 of the needles.

The slide blocks 307 are selectively driven between a retracted position RP and an advanced position AP by a suitable selectively actuatable drive such as a fluid generated piston.

In use, selected plates 301 are moved to their operative position and the slide blocks are advanced to the AP position. Accordingly operative plates 301 engage corresponding butts 330 and move their associated needles up the tricks in the bed. The plates 301 are moved to their in-operative position and the slide blocks moved to their RP position. The needles moved by the selected plates now reside in a position whereat they can be engaged by the knitting cam box of the knitting machine for knitting.

These needles may be retracted to an inactive position by reversal of the above sequence of operation of the plates 301.

The provision of plates 301 enables the number of needles in the bed to be selectively varied for knitting.

What is claimed is:

1. A knitting machine including a first knitting station for knitting a welt, a second knitting station comprising a fully fashioned knitting head, and a transfer system including a welt transfer bar and a transfer bar transport system, the transfer bar being movable by the transport system from a loading station, whereat a welt knitted at the first knitting station can be directly loaded onto the transfer bar, to an unloading station whereat the knitted welt loaded on the transfer bar can be directly transferred to the knitting head at the second knitting station.

2. A knitting machine according to claim 1 wherein the transport system includes a carriage which is movable between said loading and unloading stations, the transfer bar being movably mounted on said carriage for movement between a transport position and a welt loading position at said first knitting station.

3. A knitting machine according to claim 2 wherein the carriage is movable along a rail which is movably mounted for movement toward said first knitting station.

4. A knitting machine including a first knitting station for knitting a welt, a second knitting station comprising a fully fashioned knitting head, and a transfer system including a welt transfer bar and a transfer bar transport system, said transfer bar being movable by said transport system from a loading station, whereat a welt knitted at the first knitting station can be loaded onto said transfer bar, to an unloading station whereat the knitted welt loaded on said transfer bar can be transferred to the knitting head at the second knitting station, said transport system including a carriage which is movable between said loading and unloading stations, said transfer bar being movably mounted on said carriage for movement between a transport position and a welt loading position at the first knitting station, said carriage including a pair of spaced guide arms in which opposed ends of said transfer bar is slidably guided, drive means being provided for moving said transfer bar along said arms.

5. A knitting machine according to claim 2 wherein first knitting station includes a V-bed knitting head for knitting said welts, the welt transfer bar being moved by said carriage between said loading and unloading stations along a path parallel to the V-bed and being movably mounted on said carriage for unloading a welt from the needles on the rearmost bed of said V-bed.

6. A knitting machine according to claim 5 wherein the transfer bar is guided so as to penetrate loops held on said needles of the rearmost bed at a position behind the hook of said needles.

7. A knitting machine including a first knitting station for knitting a welt, a second knitting station comprising a fully fashioned knitting head, said fully fashioned knitting head including at least one pair of narrowing combs, each comb of each pair being associated with a respective linear motor arranged to move the associated comb across said knitting head, and electronic control means for positioning each linear motor at a desired position relative to said knitting head, and a transfer system including a welt transfer bar and a transfer bar transport system, said transfer bar being movable by said transport system from a loading station, whereat a welt knitted at the first knitting station can be loaded onto said transfer bar, to an unloading station whereat the knitted welt loaded on said transfer bar can be transferred to the knitting head at the second knitting station.

8. A knitting machine according to claim 7 wherein the fully fashioned knitting head includes two pairs of narrowing combs.

9. A knitting machine according to claim 7 wherein the linear motors associated with the or each pair of narrowing combs are mounted on a common carrier bar which is fixedly mounted to prevent its longitudinal movement.

10. A knitting machine according to claim 7 wherein the fully fashioned knitting head includes a plurality of yarn carriers and a linear motor for selectively driving said yarn carriers.

11. A knitting machine including a first knitting station for knitting a welt, a second knitting station comprising a fully fashioned knitting head, and a transfer system including a welt transfer bar and a transfer bar transport system, said transfer bar being movable by said transport system from a loading station, whereat a welt knitted at the first knitting station can be loaded onto said transfer bar, to an unloading station whereat the knitted welt loaded on said transfer bar can be transferred to the knitting head at the second knitting station, said transport system including a carriage which is movable between said loading and unloading stations, said transfer bar being movably mounted on said carriage for movement between a transport position and a welt loading position at the first knitting station, said carriage being movable along a rail which is movably mounted for movement toward the first knitting station, said carriage including a pair of spaced guide arms in which opposed ends of the transfer bar are slidably guided, drive means being provided for moving said transfer bar along said arms.

12. A knitting machine including a first knitting station for knitting a welt, a second knitting station comprising a fully fashioned knitting head, and a transfer system including a welt transfer bar and a transfer bar transport system, said transfer bar being movable by said transport system from a loading station, whereat a welt knitted at the first knitting station can be loaded onto said transfer bar, to an unloading station whereat the knitted welt loaded on said transfer bar can be transferred to the knitting head at the second knitting station, said transport system including a carriage which is movable between said loading and unloading stations, said transfer bar being movably mounted on said carriage for movement between a transport position and a welt loading position at the first knitting station, said carriage is being movable along a rail which is movably mounted for movement toward the first knitting station, the first knitting station including a v-bed knitting head having needles for knitting the welts, said transfer bar being moved by said carriage between said loading and unloading stations along a path parallel to the V-bed and being movably mounted on said carriage for unloading a welt from the needles on the rearmost bed of said V-bed.

13. A knitting machine according to claim 4 wherein first knitting station includes a V-bed knitting head for knitting said welts, the welt transfer bar being moved by said carriage between said loading and unloading stations along a path parallel to the V-bed and being movably mounted on said carriage for unloading a welt from the needles on the rearmost bed of said V-bed.

14. A knitting machine according to claim 8 wherein the linear motors associated with the or each pair of narrowing combs are mounted on a common carrier bar which is fixedly mounted to prevent its longitudinal movement.

15. A knitting machine according to claim 8 wherein the fully fashioned knitting head includes a plurality of yarn carriers and a linear motor for selectively driving said yarn carriers.

16. A knitting machine according to claim 9 wherein the fully fashioned knitting head includes a plurality of yarn carriers and a linear motor for selectively driving said yarn carriers.

17. A knitting machine including a first knitting section having a knitting head capable of producing knitted welts and a second knitting section comprising a fully fashioned knitting head capable of producing fully fashioned garment panels, and a transfer system including a welt transfer bar and a transfer bar transport system, said transfer bar having a comb of transfer needles For co-operation with knitting needles located at said knitting heads of said first and second knitting sections, said transfer bar being movable by said transport system from a loading station whereat said transfer needles co-operate with the knitting needles at said first knitting section to enable a welt knitted at said first knitting section to be loaded onto said transfer bar to an unloading station whereat said transfer needles co-operate with the knitting needles at said second knitting section to enable the knitted welt loaded onto said transfer bar to be transferred to said knitting head at said second knitting section.

18. A knitting machine according to claim 17 wherein said transport system includes a carriage which is movable between said loading and unloading stations, said transfer bar being movably mounted on said carriage for movement between a transport position and a welt loading position at said first knitting station.

19. A knitting machine according to claim 18 wherein said carriage is movable along a rail which is movably mounted for movement toward said first knitting station.

20. A knitting machine according to claim 18 wherein said carriage includes a pair of spaced guide arms in which opposed ends of said transfer bar are slidably guided, drive means being provided for moving said transfer bar along said arms.

21. A knitting machine according to claim 18 wherein said first knitting section includes a V-bed knitting head for knitting the welts, said transfer bar being moved by said carriage between said loading and unloading stations along a path parallel to the V-bed knitting head and being movably mounted on said carriage for unloading a welt from the needles on the rearmost bed of the V-bed.

22. A knitting machine according to claim 21 wherein said transfer bar is guided so as to penetrate loops held on the needles of the rearmost bed at a position behind the hook of the needles.

23. A knitting machine according to claim 17 wherein said fully fashioned knitting head includes at least one pair of narrowing combs, each comb of each said pair of combs being associated with a respective linear motor arranged to move the associated comb across said knitting head, and electronic control means for positioning each said linear motor at a desired position relative to said knitting head.

24. A knitting machine according to claim 23 wherein said fully fashioned knitting head includes two pairs of said narrowing combs.

25. A knitting machine according to claim 23 wherein each of said linear motors associated with one pair of said pairs of combs is mounted on a common carrier bar fixedly mounted to prevent its longitudinal movement.

26. A knitting machine according to claim 23 wherein said fully fashioned knitting head includes a plurality of yarn carriers and a linear motor for selectively driving said yarn carriers.

* * * * *